US007514644B2

(12) United States Patent
Chen et al.

(10) Patent No.: US 7,514,644 B2
(45) Date of Patent: Apr. 7, 2009

(54) SAFETY SWITCH CONTROL MECHANISM OF EXERCISER

(75) Inventors: Yuan-Chen Chen, Taoyuan County (TW); Hung-Chih Tseng, Taoyuan County (TW)

(73) Assignee: Helathstream Taiwan, Inc. (TW)

( * ) Notice: Subject to any disclaimer, the term of this patent is extended or adjusted under 35 U.S.C. 154(b) by 0 days.

(21) Appl. No.: 11/774,801

(22) Filed: Jul. 9, 2007

(65) Prior Publication Data

US 2008/0217150 A1 Sep. 11, 2008

(51) Int. Cl.
*H01H 9/20* (2006.01)
*H01H 13/00* (2006.01)
*H01H 13/14* (2006.01)

(52) U.S. Cl. ..... 200/334; 200/43.07

(58) Field of Classification Search ..... 200/334
See application file for complete search history.

(56) References Cited

U.S. PATENT DOCUMENTS 6,084,185 A * 7/2000 Bachle ..... 200/43.07
6,307,167 B1 * 10/2001 Kajio et al. ..... 200/43.11
6,861,597 B2 * 3/2005 Baechle ..... 200/43.04
2006/0090992 A1 * 5/2006 Takenaka et al. ..... 200/334

* cited by examiner

*Primary Examiner*—Elvin G Enad
*Assistant Examiner*—Lheiren Mae A Anglo
(74) *Attorney, Agent, or Firm*—Browdy and Neimark, P.L.L.C.

(57) ABSTRACT

A safety switch control mechanism includes a linkage and a safety control key. The linkage has a bracket mounted to an instrument panel of an exerciser and a wheel thereof rotatably mounted to the bracket. The instrument panel includes a keyhole located at an opposite side thereof to the bracket. The wheel has at least one hook portion formed at an outer periphery thereof, and a holding portion and a releasing portion formed at one side thereof. The safety control key has a through hole for engaging said at hook portion. When the safety control key is inserted into or pulled away from the keyhole, the sidewall of the through hole forces clockwise or counterclockwise rotation of the wheel to further shift the releasing portion for contact against a micro switch mounted to the instrument panel, and thus the micro switch is driven to switch on or off the power supply of the exerciser.

12 Claims, 5 Drawing Sheets

SAFETY SWITCH CONTROL MECHANISM OF EXERCISER

BACKGROUND OF THE INVENTION

1. Field of the Invention

The present invention relates to exercisers and more specifically, to a safety switch control mechanism of an exerciser.

2. Description of the Related Art

An exerciser, for example, a treadmill has a safety switch to prevent a child's arbitrary, careless, or accidental triggering of the power control switch thereof from endangering the child, or to automatically switch off the power supply when the user falls from the machine accidentally during exercise. Without the safety switch, the user's clothes may be rolled into the machine when the user falls from the machine accidentally during exercise, potentially injuring the user. In such exerciser, the safety switch is installed in the instrument panel for switching on/off the power supply of the exerciser, and an extractable plug pin is inserted into the safety switch in linkage with the plug pin for turning on the power supply of the exerciser. A cord member is linked between the plug pin and the user's body. When the user falls from the treadmill accidentally during exercise, the cord member will wrest the plug pin to further pull the plug pin away from the safety switch, causing the safety switch to switch off the power supply of the exerciser. Further, after the exercise, the user can pull the plug pin away from the safety switch to switch off the power supply of the exerciser, preventing potentially accidental triggering of the power control switch.

The aforesaid safety switch design is still not satisfactory in function. It does not use any linking means or position limiter to assure high reliability. Simply by means of inserting the plug pin into the safety switch or pulling the plug pin away from the safety switch cannot assure accurate operation of the safety switch. The safety switch may be not activated after insertion or separation of the plug pin.

Further, this design cannot prohibit a child from inserting a similar rod member into the safety switch and then potentially switching on the power supply of the exerciser. Briefly, the security level of this design of safety switch is low.

SUMMARY OF THE INVENTION

The present invention has been accomplished under the circumstances in view. It is one object of the present invention to provide a safety switch control mechanism for exerciser, which accurately drives the power control switch to switch on/off the power supply of the exerciser.

It is another object of the present invention to provide a safety switch control mechanism for exerciser, which is structurally special to prohibit any other external object from driving the power control switch to assure high security.

To achieve the foregoing objects of the present invention, the safety switch control mechanism is installed in an instrument panel of an exerciser for controlling the power supply of the exerciser. The safety switch control mechanism is composed of a linkage and a safety control key. The linkage includes a bracket fixedly mounted to an inner wall of the instrument panel, and a pivot unit mounted to the bracket. The instrument panel has a keyhole formed at an outer wall thereof, and a micro switch for switching on/off the power supply of the exerciser. The pivot unit includes a wheel rotatably supported inside the bracket, having at least one hook portion formed at an outer periphery of the wheel, and a holding portion and a releasing portion, both of which are formed at one side of the wheel. The holding portion and the releasing portion are located at different planes. The safety control key includes a grip, and a plate-like actuation portion extending from one end of the grip for inserting into the keyhole. The actuation portion has a through hole cut through two opposite sides thereof. When inserting the plate-like actuation portion of the safety control key into the keyhole, a sidewall of the through hole of the plate-like actuation portion of the safety control key forces the wheel to rotate clockwise and to further shift the releasing portion to contact against the micro switch, causing the micro switch to switch on the power supply of the exerciser. When the safety control key is pulled away from the keyhole, the through hole of the plate-like actuation portion of the safety control key forces the wheel to rotate counterclockwise and to further enable the micro switch to lie on the holding portion, causing the micro switch to switch off the power supply of the exerciser.

DETAILED DESCRIPTION OF THE INVENTION

Figure 1:
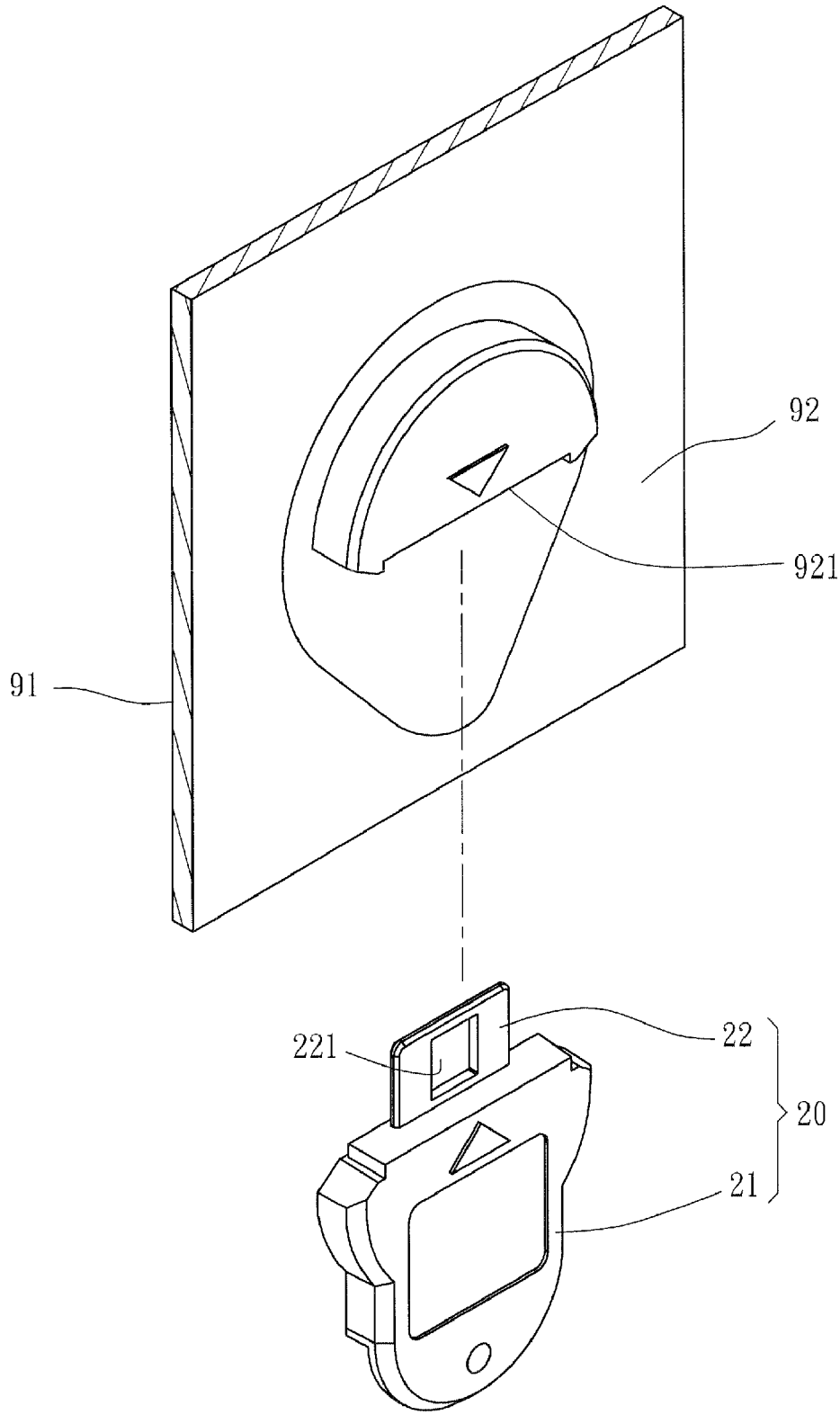
FIG. 1 is a perspective view of a safety switch control mechanism of the present invention, illustrating that the detachment of the linkage and the safety control key.
Figure 2:
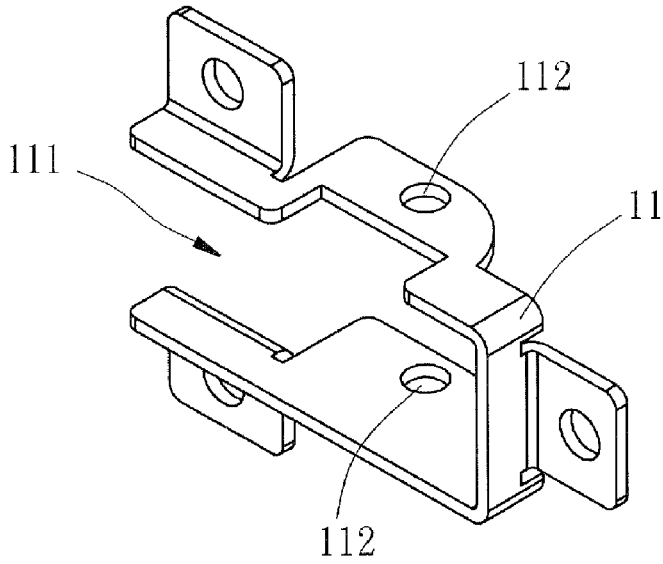
FIG. 2 is a perspective view of a part of the safety switch control mechanism of the present invention, showing the structure of the bracket.
Figure 3:
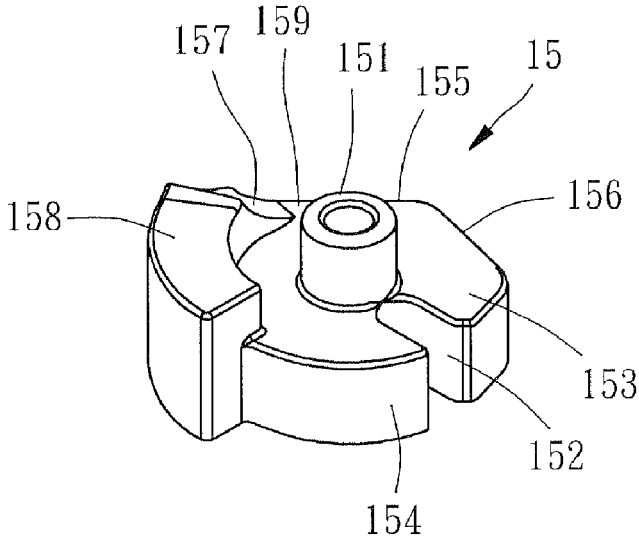
FIG. 3 is a perspective view of a part of the safety switch control mechanism of the present invention, showing the structure of the wheel of the linkage.

Referring to FIGS. 1-7, a safety switch control mechanism 100 in accordance with a preferred embodiment of the present invention is shown comprised of a linkage 10 and a safety control key 20.

The linkage 10 includes a bracket 11, a pivot unit 12, and a limiting springy piece 13. The bracket 11 is fixedly mounted to an inner sidewall 91 of an instrument panel (not shown) of an exerciser (not shown), having a central accommodation space 111 and two pivot holes 112 aligned at two opposite sides of the central accommodation space 111. The pivot unit 12 includes a pivot rod 14 and a wheel 15. The wheel 15 has a central axial hole 151. The pivot rod 14 is inserted through the central axial hole 151 of the wheel 15, having two opposite ends inserted through the two pivot holes 112 of the bracket 11 respectively to support the wheel 15 in the central accommodation space 111, allowing rotation of the wheel 15 on the pivot rod 14. The wheel 15 further has a radial retaining slot 152, a first hook portion 153 and a second hook portion 154 formed at two sides of the radial retaining slot 152 respectively, a flat first stop face 155 formed on an outer periphery thereof, a second stop face 156 formed on the outer periphery thereof and abutted against the first stop face 155, a sloping edge 157 formed at an outer side thereof, a relatively thicker holding portion 158 formed at an end of the sloping edge 157, and a relatively thinner releasing portion 159 formed at the other end of the sloping edge 157. The limiting springy piece 13 has two ends, one of which is fixedly fastened to the inner sidewall 91 of the instrument panel of the exerciser and the other defined as a free end is located in the central accommodation space 111 of the bracket 11.

The safety control key 20 has a grip 21 for holding by the user, and a plate-like actuation portion 22 extending from one end of the grip 21. The actuation portion 22 has a through hole 221 cut through two opposite sides thereof. In this embodiment, the through hole 221 is rectangular in shape.

The features and method as to how to use of the safety switch control mechanism 100 are described hereinafter with reference to FIGS. 4 and 5. The instrument panel of the exerciser has a keyhole 921 cut through an outer sidewall 92 and in communication with the inner sidewall 91. The keyhole 921 has one end facing the central accommodation space 111 of the bracket 11. The free end of the limiting springy piece 13, located in the central accommodation space 111, lies on the first stop face 155 of the wheel 15 to enable the retaining slot 152 to be aligned with the keyhole 921 of the instrument panel. Further, a micro switch 93 is mounted on the inner sidewall 91 of the instrument panel for turning on/off the power supply of the exerciser. The micro switch 93 has an actuating rod 931 supported on the relatively thicker holding portion 158 of the wheel 15 so that the holding portion 138 drives the actuating rod 931 to a power-off position where the micro switch 93 switches off the power supply of the exerciser.

Figure 7:
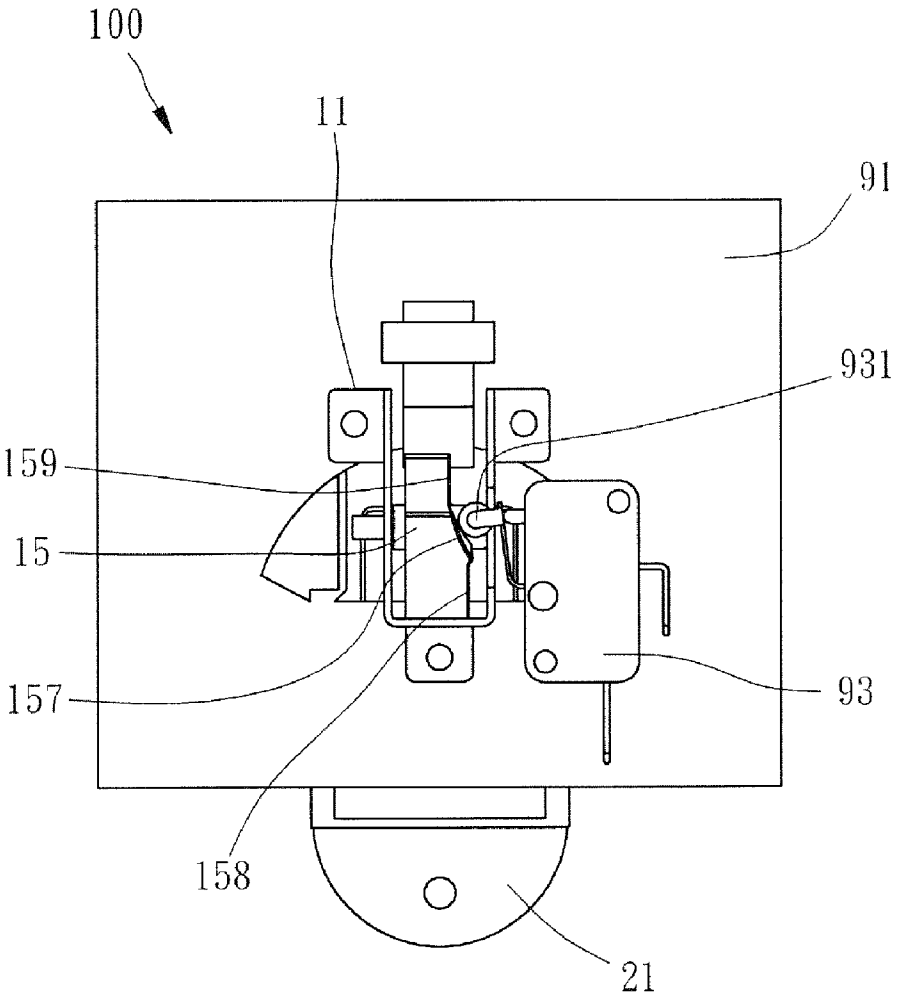
FIG. 7 is a schematic view of the safety switch control mechanism of the present invention, illustrating the position of the micro switch after insertion of the safety control key into the linkage.
Figure 6:
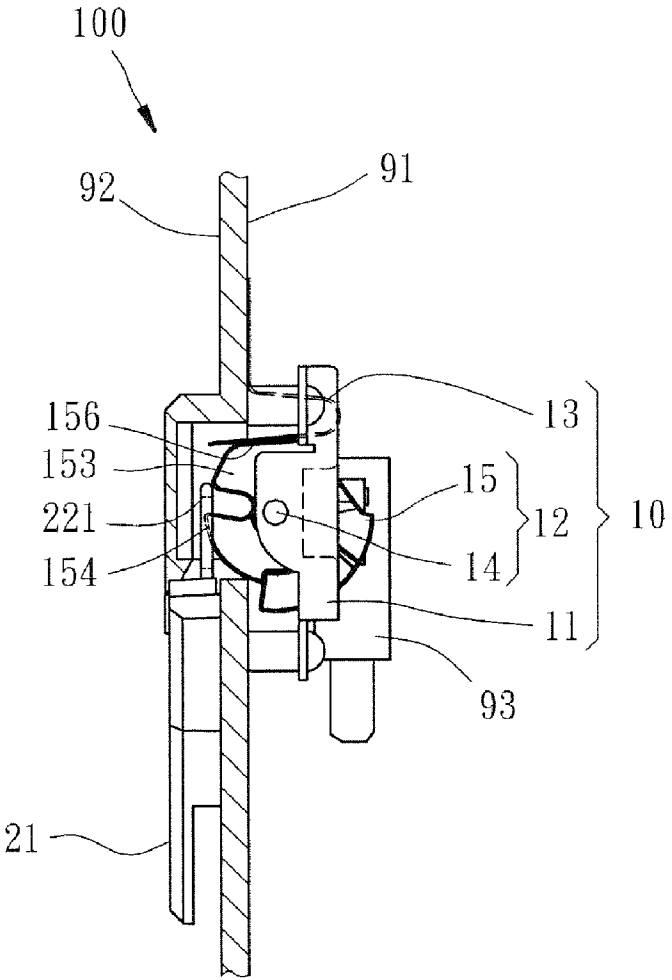
FIG. 6 is a schematic sectional view of the safety switch control mechanism of the present invention, illustrating the position of the wheel of the linkage after insertion of the safety control key into the linkage.

When intending to turn on the power supply of the exerciser, as shown in FIGS. 6 and 7, the user can insert the plate-like actuation portion 22 of the safety control key 20 into the keyhole 921 of the instrument panel. When the plate-like actuation portion 22 of the safety control key 20 is inserted into the keyhole 921 of the instrument panel, a tip of the plate-like actuation portion 22 contacts against and then pushes the first hook portion 153 of the wheel 15 to bias the wheel 15 against the limiting springy piece 13, causing the second hook portion 154 to be engaged into the through hole 221 of the actuation portion 22 during rotary motion of the wheel 15, and therefore the second hook portion 154 locks the safety control key 20. At the same time, the first stop face 155 is moved away from the free end of the limiting springy piece 13 and the second stop face 156 is forced into contact with the free end of the limiting springy piece 13. Thus, the actuating rod 931 of the micro switch 93 is guided by the sloping edge 157 from the holding portion 158 to the releasing portion 159. In other words, the actuating rod 931 is moved from the power-off position to the power-on position where the micro switch 93 switches on the power supply of the exerciser.

Figure 4:
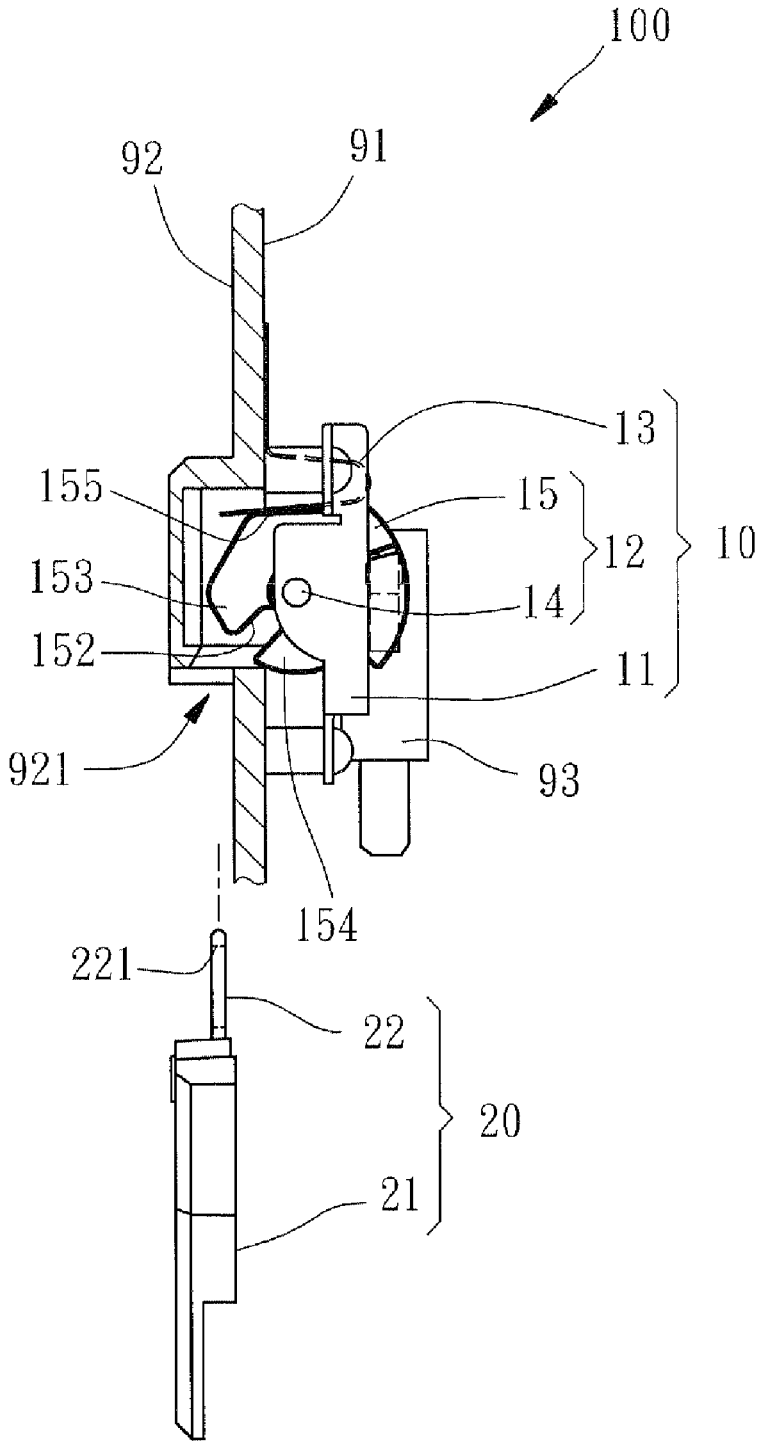
FIG. 4 is a schematic sectional view of the safety switch control mechanism of the present invention, illustrating the position of the wheel of the linkage after detachment of the safety control key from the linkage.
Figure 5:
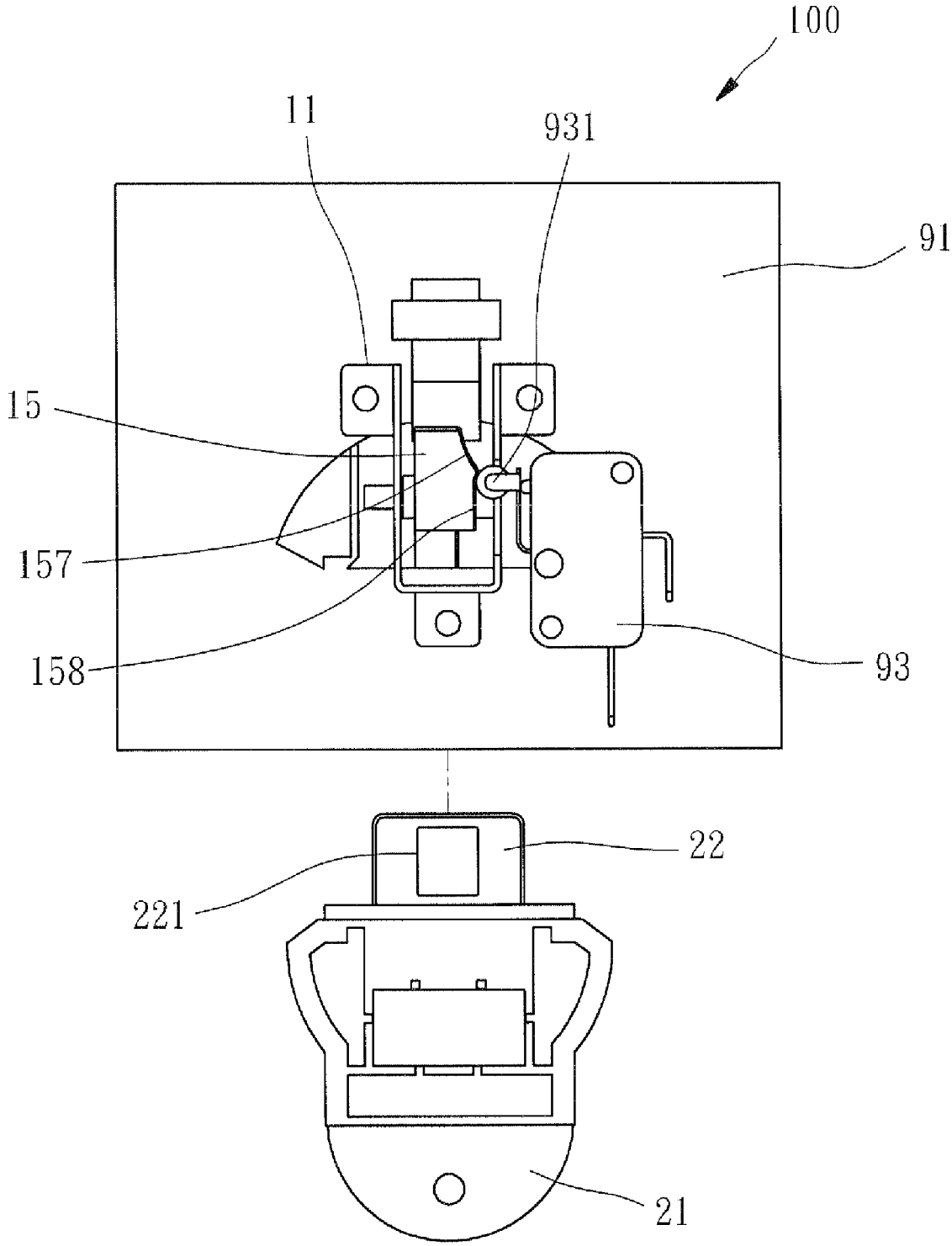
FIG. 5 is a schematic view of the safety switch control mechanism of the present invention, illustrating the position of the micro switch after detachment of the safety control key from the linkage.

When the user pulls the safety control key 20 away from the keyhole 921 directly or if the user falls accidentally during exercise to wrest the drag rope connected between the user's body and the safety control key 20 and to further pull the safety control key 20 away from the keyhole 921, as shown in FIGS. 4 and 5, the sidewall of the through hole 221 of the safety control key 20 drives the second hook portion 154 to bias the wheel 15, forcing the second stop face 156 away from the free end of the limiting springy piece 13 and meanwhile forcing the first stop face 155 to contact against the free end of the limiting springy piece 13. In the meantime, the actuating rod 931 of the micro switch 93 is guided by the sloping edge 157 from the releasing portion 159 to the holding portion 158. In other words, the actuating rod 931 is moved from the power-on position to the power-off position where the micro switch 93 switches off the power supply of the exerciser.

Therefore, by inserting the safety control key 20 into the keyhole 921 to rotate the wheel 12 of the linkage 10 in one direction or pulling the safety control key 20 out of the keyhole 921 to rotate the wheel 12 of the linkage 10 in the reversed direction, the actuating rod 931 of the micro switch 93 is shifted between the power-on position and the power-off position to turn on or off the power supply of the exerciser, achieving safety control of the exerciser.

In addition, the safety control key 20 is provided with the particularly shaped through hole 221 for driving rotation of the wheel 12 of the linkage 10, such that any other external object inserted into the through hole 221 cannot do the same work. Therefore, the invention prevents a child from turning on the power supply of the exerciser accidentally or arbitrarily.

Although a particular embodiment of the invention has been described in detail for purposes of illustration, various modifications and enhancements may be made without departing from the spirit and scope of the invention. Accordingly, the invention is not to be limited except as by the appended claims

What is claimed is:

1. A safety switch control mechanism installed in an instrument panel of an exerciser for controlling power supply of said exerciser, said safety switch control mechanism comprising:

a linkage having a bracket and a pivot unit, said bracket being fixedly mounted to a side of said instrument panel, a pivot unit being mounted to said bracket, said instrument panel having a keyhole being formed at the other opposite side thereof, a micro switch being mounted to said instrument panel for switching on/off the power supply of said exerciser, said pivot unit having a wheel rotatably supported inside said bracket, said wheel having at least one hook portion, a holding portion, and a releasing portion, said at least one hook portion being formed at an outer periphery of said wheel, said holding and releasing portions being formed at a side of said wheel and in different planes; and a safety control key, said safety control key having a grip and a plate-like actuation portion extending from one end of said grip for inserting into said keyhole, said actuation portion having a through hole cut through two opposite sides thereof;

wherein after said plate-like actuation portion of said safety control key is inserted into said keyhole, a sidewall of said through hole of said plate-like actuation portion of said safety control key drives clockwise rotation of said wheel to further shift said releasing portion for contact against said micro switch, so that said micro switch is driven to switch on the power supply of said exerciser, when said safety control key is pulled away from said keyhole, the sidewall of said through hole of said plate-like actuation portion of said safety control key drives counterclockwise rotation of said wheel to further shift said holding portion for contact against said micro switch, so that said micro switch is driven to switch off the power supply of said exerciser;

wherein said wheel comprises a first stop face and a second stop face, said first stop face being formed at an outer periphery of said wheel, said second stop face being abutted against said first stop face; said linkage further comprises a limiting springy piece, said limiting springy piece having two ends, one of which is fixed to said instrument panel and the other end defined as a free end is stopped at said second stop face when said safety control key is inserted into said keyhole, said free end being stopped at said first stop face when said safety control key is detached from said keyhole.

2. The safety switch control mechanism as defined in claim 1, wherein said wheel comprises a radial retaining slot extending to an outer periphery thereof; said at least one hook portion comprises a first hook portion and a second hook portion, both of which are located at opposite sides of said retaining slot; when said safety control key is inserted into said keyhole; said plate-like actuating portion pushes said first hook portion of said wheel to force said second hook portion into said through hole of said plate-like actuation portion.

3. The safety control mechanism as defined in claim 2, wherein said wheel further comprises a sloping edge extending obliquely downwards from said holding portion to said releasing portion for guiding said holding portion and said releasing portion for contact against said micro switch alternately.

4. The safety control mechanism as defined in claim 2, wherein said holding portion is formed at a relatively thick portion of said wheel and said releasing portion is formed at a relatively thin portion of said wheel.

5. The safety control mechanism as defined in claim 2, wherein said through hole of said plate-like actuation portion is rectangular in shape.

6. The safety control mechanism as defined in claim 1, wherein said wheel further comprises a sloping edge extending obliquely downwards from said holding portion to said releasing portion for guiding said holding portion and said releasing portion for contact against said micro switch alternately.

7. The safety control mechanism as defined in claim 1, wherein said holding portion is formed at a relatively thick portion of said wheel and said releasing portion is formed at a relatively thin portion of said wheel.

8. The safety control mechanism as defined in claim 1, wherein said through hole of said plate-like actuation portion is rectangular in shape.

9. A safety switch control mechanism installed in an instrument panel of an exerciser for controlling power supply of said exerciser, said safety switch control mechanism comprising:

a linkage having a bracket and a pivot unit, said bracket being fixedly mounted to a side of said instrument panel, a pivot unit being mounted to said bracket, said instrument panel having a keyhole being formed at the other opposite side thereof, a micro switch being mounted to said instrument panel for switching on/off the power supply of said exerciser, said pivot unit having a wheel rotatably supported inside said bracket, said wheel having at least one hook portion, a holding portion, and a releasing portion, said at least one hook portion being formed at an outer periphery of said wheel, said holding and releasing portions being formed at a side of said wheel and in different planes; and a safety control key, said safety control key having a grip and a plate-like actuation portion extending from one end of said grip for inserting into said keyhole, said actuation portion having a through hole cut through two opposite sides thereof;

wherein after said plate-like actuation portion of said safety control key is inserted into said keyhole, a sidewall of said through hole of said plate-like actuation portion of said safety control key drives clockwise rotation of said wheel to further shift said releasing portion for contact against said micro switch, so that said micro switch is driven to switch on the power supply of said exerciser, when said safety control key is pulled away from said keyhole, the sidewall of said through hole of said plate-like actuation portion of said safety control key drives counterclockwise rotation of said wheel to further shift said holding portion for contact against said micro switch, so that said micro switch is driven to switch off the power supply of said exerciser;

wherein said bracket comprises a central accommodation space and two pivot holes aligned at two opposite sides of said central accommodation space; said pivot unit further comprises a pivot rod mounted to said bracket, said pivot rod having two opposite ends respectively pivoted to said pivot holes of said bracket, said wheel of said pivot unit having a central axial hole, said pivot rod being inserted through said central axial hole.

10. The safety control mechanism as defined in claim 9, wherein said wheel further comprises a sloping edge extending obliquely downwards from said holding portion to said releasing portion for guiding said holding portion and said releasing portion for contact against said micro switch alternately.

11. The safety control mechanism as defined in claim 9, wherein said holding portion is formed at a relatively thick portion of said wheel and said releasing portion is formed at a relatively thin portion of said wheel.

12. The safety control mechanism as defined in claim 9, wherein said through hole of said plate-like actuation portion is rectangular in shape.

* * * * *